United States Patent [19]

Setterberg, Jr.

[11] Patent Number: 4,570,707

[45] Date of Patent: Feb. 18, 1986

[54] RELEASABLE LATCH FOR DOWNHOLE WELL TOOLS

[75] Inventor: John R. Setterberg, Jr., Richardson, Tex.

[73] Assignee: Otis Engineering Corporation, Dallas, Tex.

[21] Appl. No.: 665,754

[22] Filed: Oct. 29, 1984

Related U.S. Application Data

[63] Continuation-in-part of Ser. No. 588,147, Mar. 9, 1984, abandoned.

[51] Int. Cl.[4] ..... E21B 23/00

[52] U.S. Cl. ..... 166/214; 285/26; 285/86; 285/137.2

[58] Field of Search ..... 166/89, 116, 189, 214; 285/24, 25, 26, 27, 28, 29, 137 A

[56] References Cited

U.S. PATENT DOCUMENTS

| | | | |
|---|---|---|---|
| 2,862,560 | 12/1958 | Bostock et al. | 166/125 |
| 3,167,127 | 1/1965 | Sizer | 166/120 |
| 3,326,292 | 6/1967 | Young et al. | 166/106 |
| 3,330,360 | 7/1967 | Young | 166/106 |
| 3,381,752 | 5/1968 | Elliston | 166/120 |
| 3,391,741 | 7/1968 | Elliston | 166/123 |
| 3,450,205 | 6/1969 | Current | 166/189 |
| 3,934,648 | 1/1976 | Amancharla | 166/189 |
| 4,236,734 | 2/1980 | Ahangarzadeh | 285/26 |
| 4,290,483 | 9/1981 | Lawson | 285/137 A |
| 4,399,873 | 6/1981 | Lindsey | 166/380 |
| 4,436,325 | 3/1984 | Miller | 285/86 |
| 4,457,368 | 7/1984 | Knierimen et al. | 166/217 |

*Primary Examiner*—Stephen J. Novosad
*Assistant Examiner*—William P. Neuder
*Attorney, Agent, or Firm*—Thomas R. Felger

[57] ABSTRACT

A latch for releasably anchoring well tools at a preselected downhole location within a well bore. The latch includes collet heads which are sized to be received within an annular recess. The downhole location is defined by the annular recess and a no-go shoulder which limits the movement of the latch into the well bore. The latch is activated by application of force in one direction after contact with the no-go shoulder. A first set of pins is sheared during activation of the latch to prevent retraction of the collet heads from the recess. A second set of pins is sheared by applying force in the opposite direction to allow release of the collet heads from the recess.

20 Claims, 26 Drawing Figures

RELEASABLE LATCH FOR DOWNHOLE WELL TOOLS

This application is a continuation-in-part of my copending application Ser. No. 588,147 filed on Mar. 9, 1984 now abandoned.

BACKGROUND OF THE INVENTION

1. Field of the Invention

The present invention relates to a latch which can releasably anchor a well tool at a preselected downhole location. One embodiment of the invention, disclosed in this application, is used to releasably latch one end of a tubing string to a well packer at a downhole location within a well bore.

2. Description of the Prior Art

Many oil and gas wells are completed with two or more production tubing strings to conduct well fluids from downhole producing formations to the well surface. If desired, both production tubing strings can be installed and removed simultaneously from the well bore as taught by U.S. Pat. No. 4,236,734 invented by Mansour Ahangarzadeh. However, many well operators prefer to handle only one string of production tubing at a time.

Typically, a well packer is attached to one string of production tubing at the well surface and then lowered to the desired downhole location within the well bore. A second string of production tubing is later inserted from the well surface into the well bore and engaged with the well packer. The well packer may be anchored within the well bore either before or after engagement by the second production tubing string. U.S. Pat. No. 3,161,127 to P. S. Sizer provides a detailed description of this method for installing a well packer and dual production tubing strings within a well bore. Additional examples of multiple conduit well completions are shown in U.S. Pat. No. 3,326,292 to C. R. Young et al.; U.S. Pat. No. 3,330,360 to C. R. Young; U.S. Pat. Nos. 3,381,752 and 3,391,741 to T. L. Elliston; and U.S. Pat. No. 3,934,648 to Amareswar Amancharla et al. The above listed patents are incorporated by reference for all purposes within this application.

SUMMARY OF THE INVENTION

The present invention discloses a latch for releasably anchoring well tools at a preselected downhole location partially defined by an annular recess comprising a mandrel, means for locking the mandrel within the recess, the locking means slidably mounted on the mandrel, backup means on the mandrel movable between a first position which allows disengagement of the locking means from the recess and a second position which holds the locking means against disengagement from the recess, first frangible means holding the backup means in its first position and releasing the backup means in response to a predetermined force tending to move the backup means to its second position, and second frangible means for holding the backup means in its second position.

One object of the present invention is to provide a latch which will anchor a well tool at a preselected downhole location in response to a predetermined amount of force in one direction and will release the well tool from the downhole location in response to a predetermined amount of force in the opposite direction.

Another object of the present invention is to provide a releasable latch for well tools with a minimal number of component parts.

A further object of the present invention is to provide a latch which allows quick, reliable installation and removal of a tubing string from a downhole well packer.

Another object of the present invention is to provide a latch having a first frangible means which holds the latch in its deactivated position and a second frangible means which restricts the latch from disengagement. The second frangible means is activated by releasably anchoring the latch at a preselected downhole location.

A still further object of the present invention is to provide a pulling tool which can be releasably engaged with a downhole well tool by a first preselected amount of force in one direction and released from the well tool by a second preselected amount of force in the same direction. While engaged, force in the opposite direction does not release the pulling tool from the well tool.

Another object of the present invention is to provide a latch for releasably anchoring a well tool within the bore of a well flow conductor at a preselected location. The preselected location is defined in part by a downhole receptable which is engaged with and forms a part of the well flow conductor.

Additional objects and advantages of the present invention will be readily apparent to those skilled in the art from studying the following written description in conjunction with the drawings and claims.

DESCRIPTION OF THE PREFERRED EMBODIMENT

Figure 1:
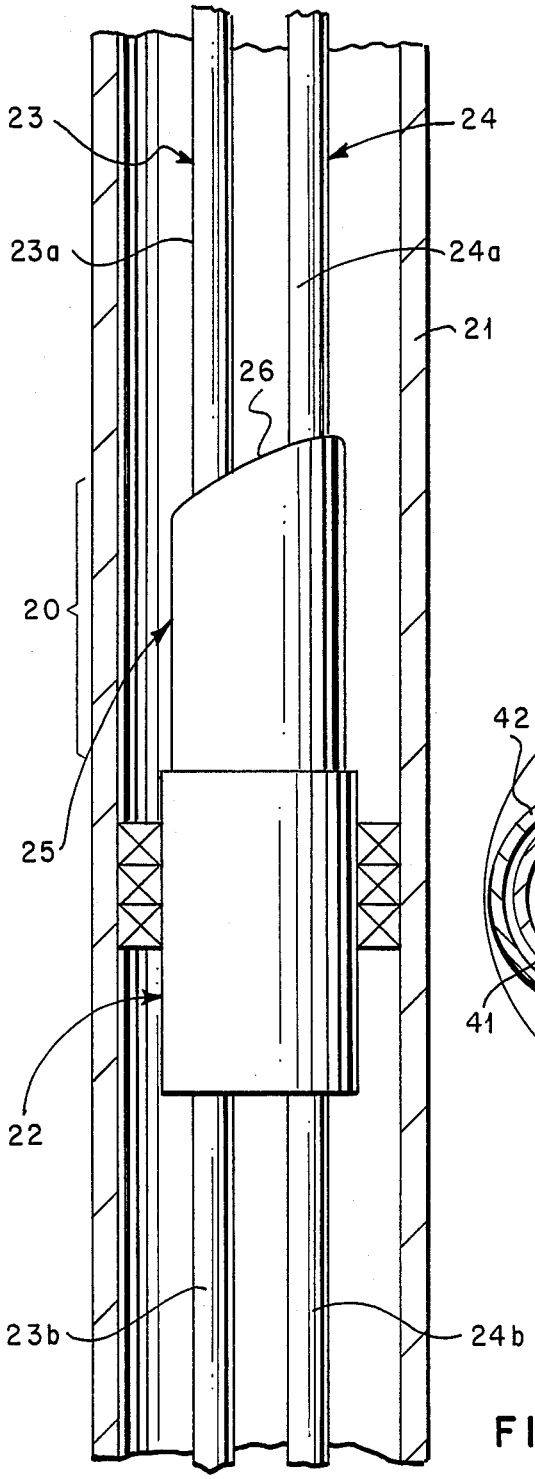
FIG. 1 is a longitudinal schematic view in section and elevation showing a typical well completion with dual production tubing strings.
Figure 5:
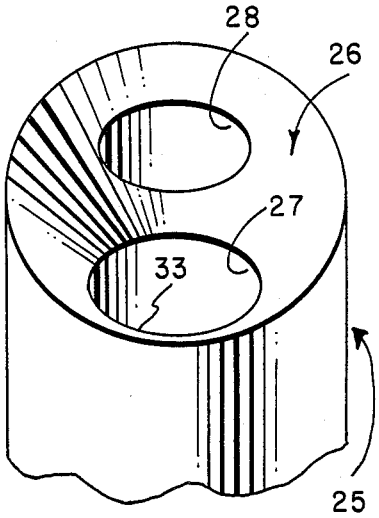
FIG. 5 is a perspective view of a self-aligning guide head employed in the embodiment of the invention shown in FIGS. 2A, B and C.
Figure 6:
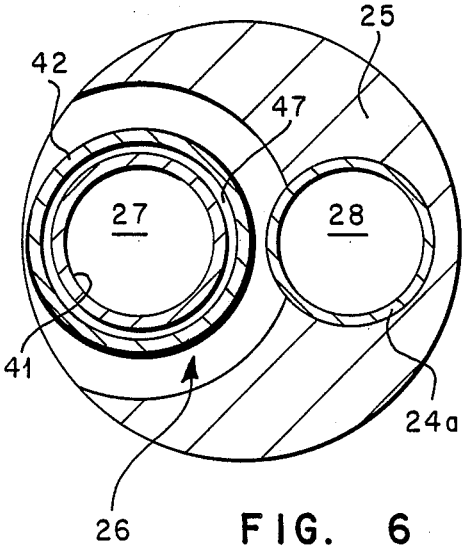
FIG. 6 is a view in section along line 6—6 of FIG. 3B.

Referring to FIG. 1, a well tubing coupling system 20 is shown within a well bore lined by casing 21. A suitable well packer 22 is set to seal with the inner wall of casing 21 at a preselected downhole location within the well bore. Packer 22 directs fluid communication between the well surface (not shown) and one or more producing formations (not shown) via well flow conduits or production tubing strings 23 and 24. The packer may be any suitable hydraulic or mechanical set dual string well packer. Lower portions 23*b* and 24*b* of tubing strings 23 and 24 are permanently attached below and supported by packer 22 within the well bore.

Coupling system 20 includes self-aligning guide head 25 with bores 27 and 28 extending longitudinally therethrough. Upper portions 23*a* and 24*a* of production tubing strings 23 and 24 are attached to and communicate with bores 27 and 28 respectively. Guide head 25 is in turn attached to packer 22 by threads 29. Fluid communicates between upper portions 23*a* and 24*a* via bores 27 and 28 of guide 25 and similar bores (not shown) in packer 22 to lower portions 23*b* and 24*b* respectively. Guide surface 26 is developed to direct upper portion 23*a* into bore 27 as will be explained later in detail. Upper portion 23*a* of production tubing string 23 may be installed and removed from guide 25 as desired.

Figure 2A:
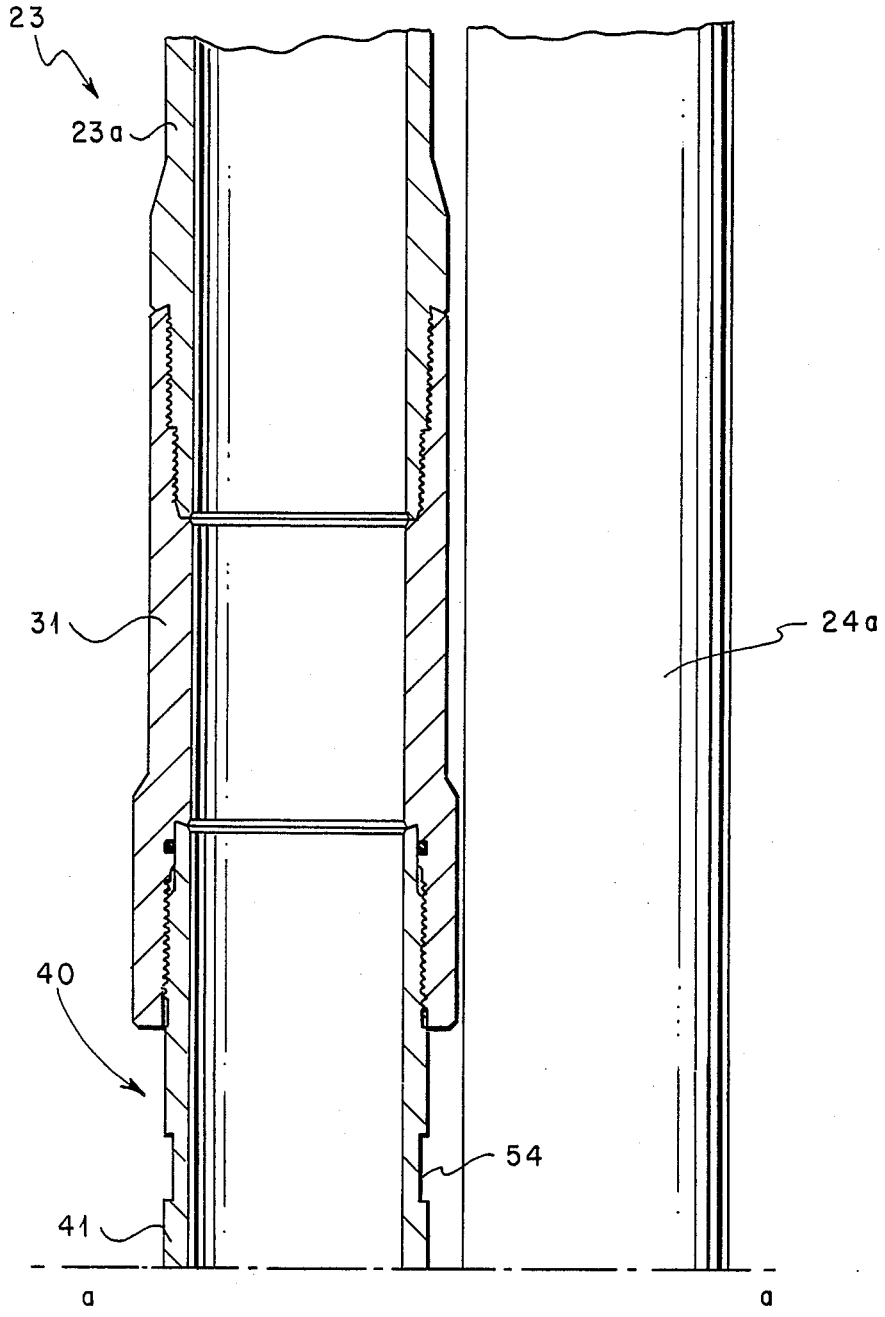
FIGS. 2A, B and C taken together constitute a longitudinal view in section and elevation with portions broken away showing one embodiment of the latch of the present invention on a production tubing string as it initially enters a self-aligning guide head of a well packer.
Figure 2B:
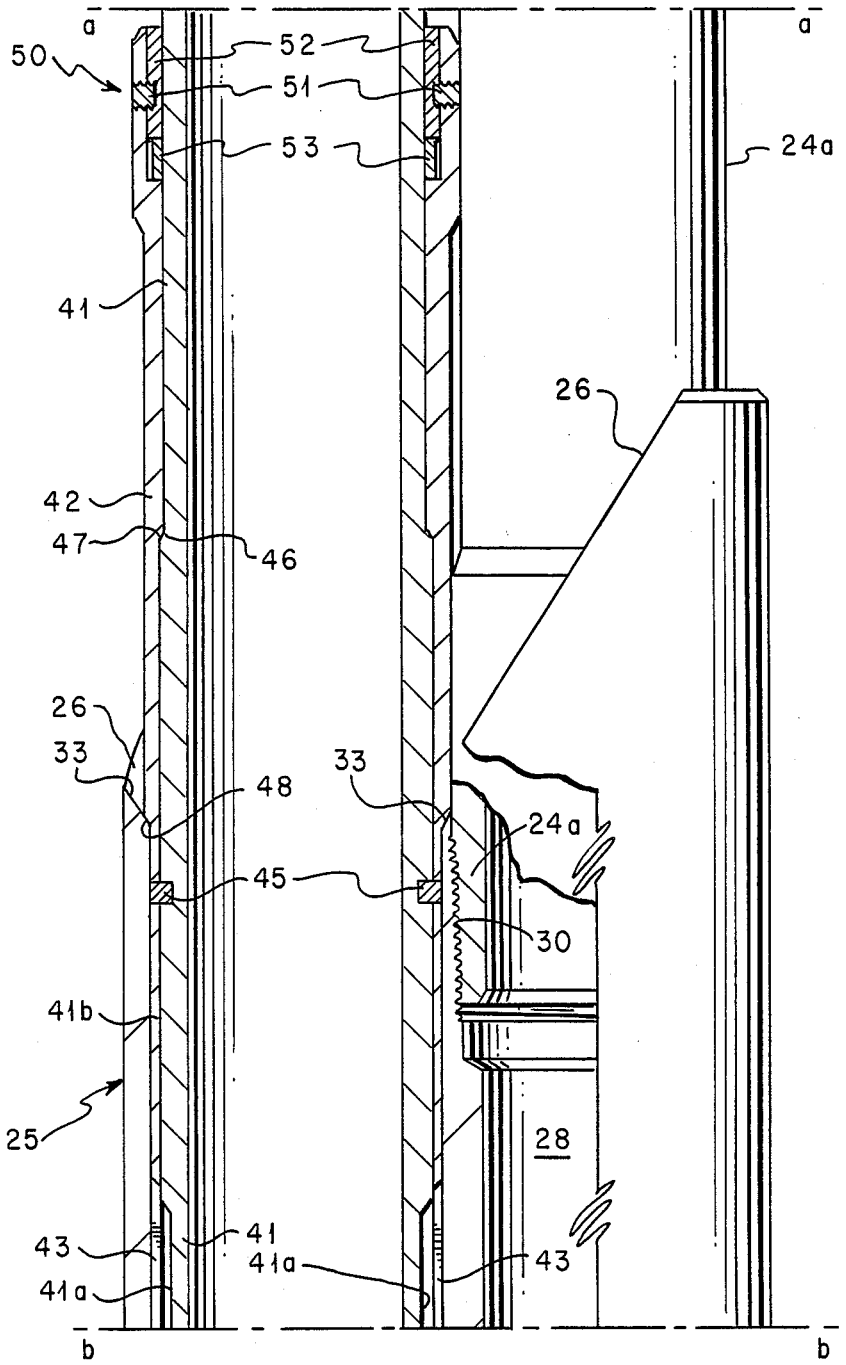
Figure 3A:
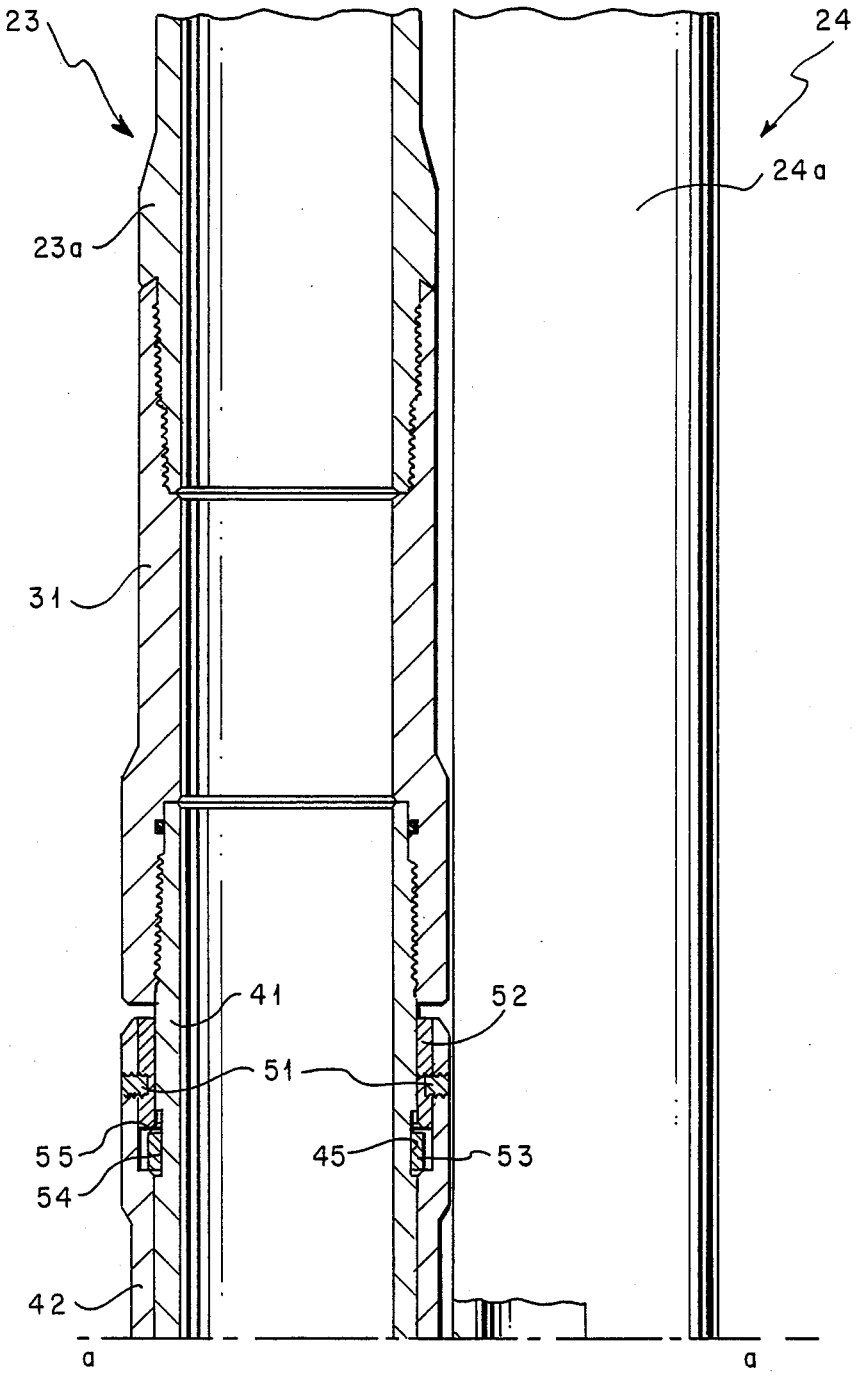
FIGS. 3A, B and C taken together constitute a longitudinal view in section and elevation with portions broken away showing the latch of FIGS. 2A, B and C releasably anchoring one end of the production tubing string within the packer guide head at a preselected downhole location.
Figure 3B:
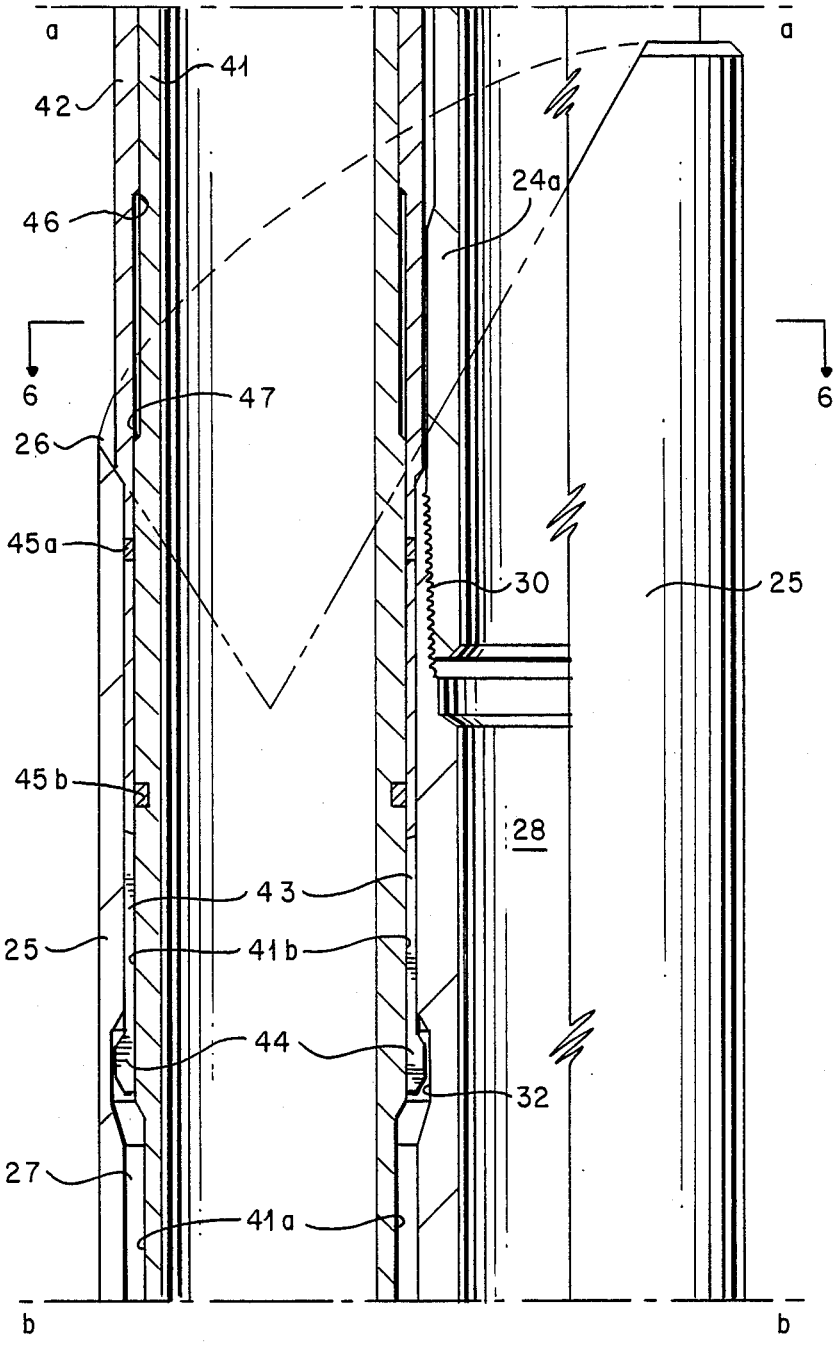
Figure 3C:
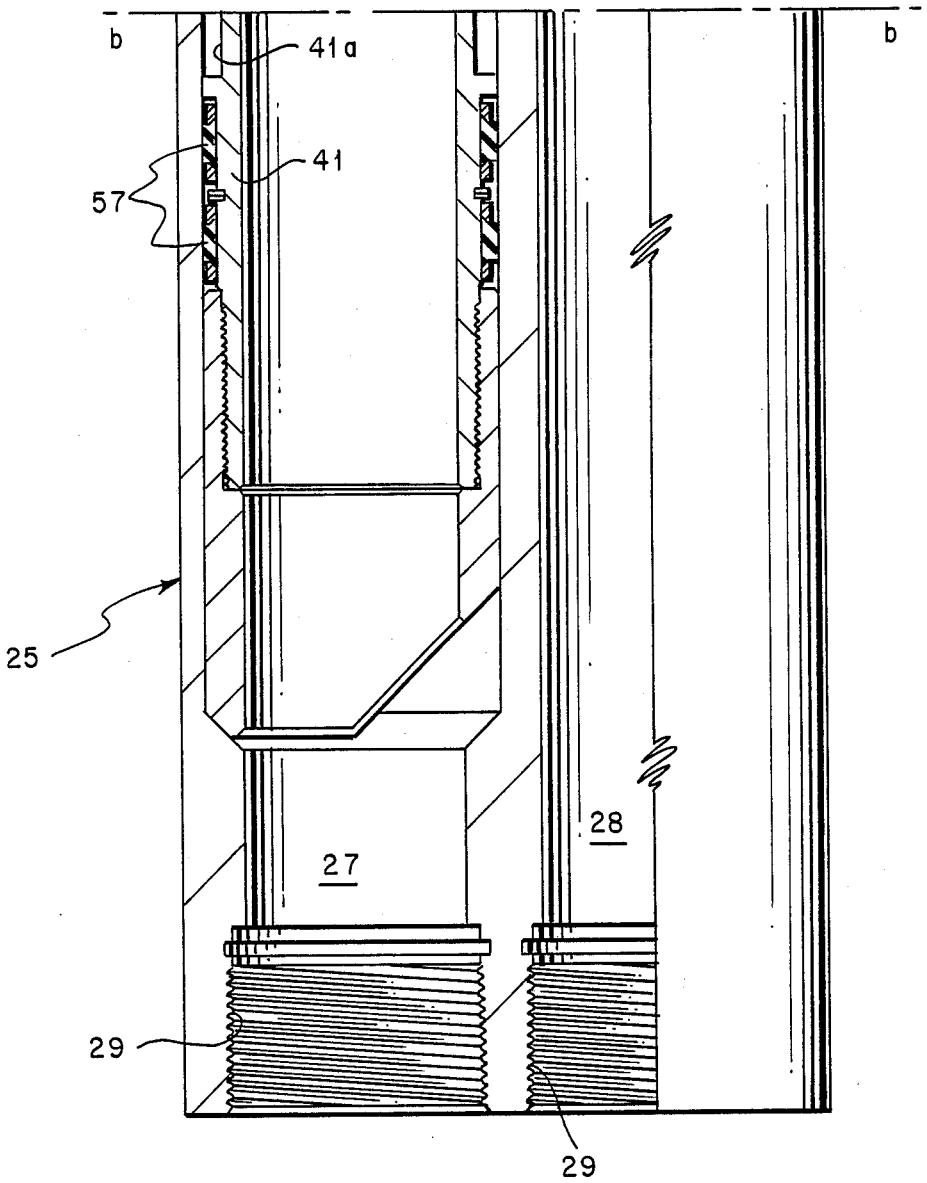

As best shown in FIGS. 2B and 3B, upper portion 24*a* is attached to guide head 25 by threads 30 within bore 28. Thus, lower portions 23*b* and 24*b*, packer 22, and guide head 25 may be lowered as a single unit into the well bore by production tubing string 24. For this embodiment of the present invention, production tubing string 24 remains permanently attached to packer 22. When desired for specific well conditions, well packer 22 may be sealingly engaged with casing 21 either before or after upper portion 23*a* of production tubing string 23 is releasably anchored within bore 27.

Latch or locking device 40 is attached to upper portion 23*a* by short tubular means 31 sometimes referred to as a crossover assembly. Various crossover assemblies and other threaded connections are readily available to provide means for connecting latch 40 to a production tubing string. Latch 40 can be used to releasably anchor a wide variety of well tools within a well bore as a preselected downhole location is provided with an appropriate no-go shoulder and annular locking recess. Guide head 25 provides such no-go shoulder 33 and locking recess 32.

Figure 2C:
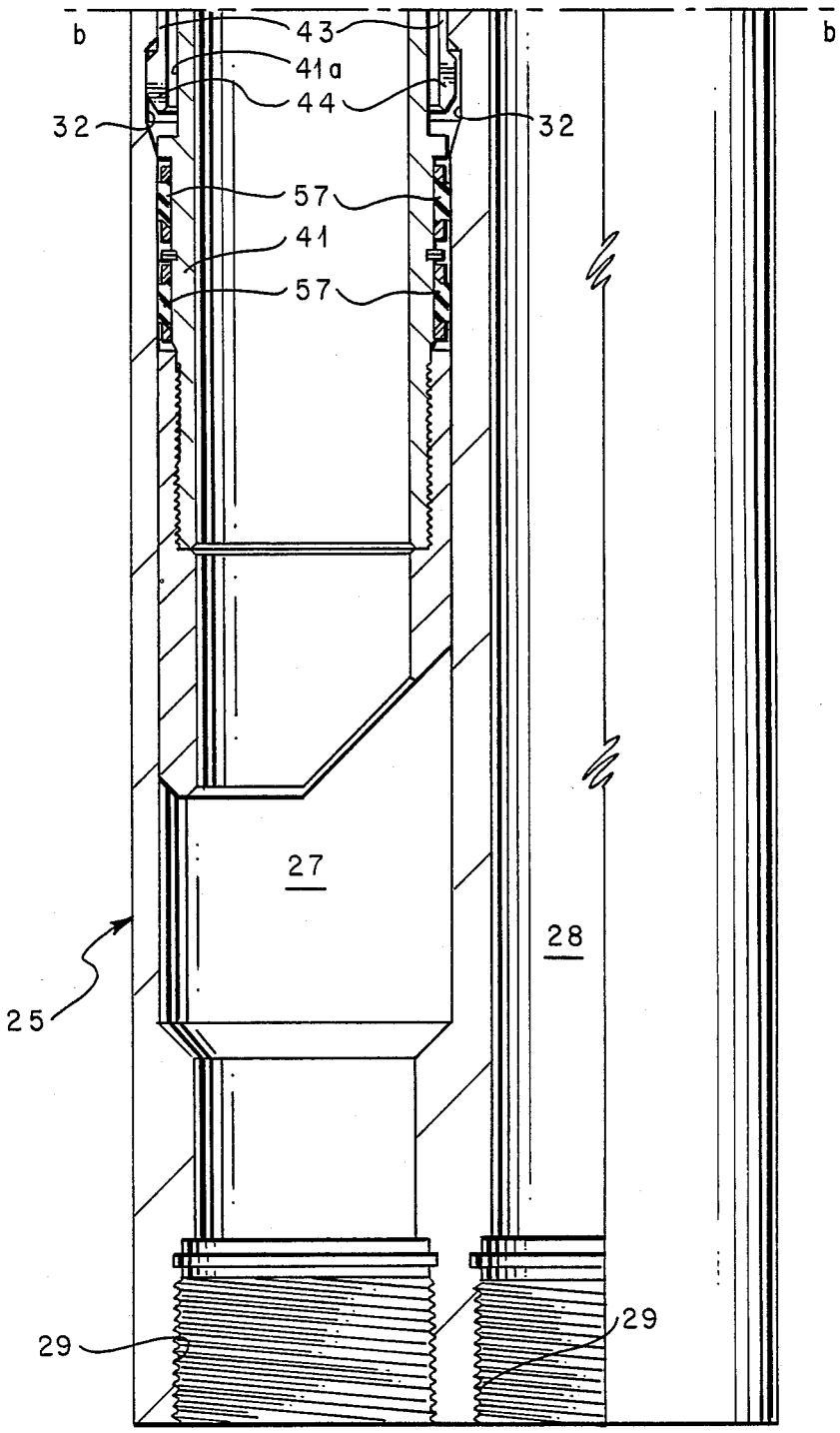

The various components of latch 40 are carried by and attached to a hollow, elongated tubular member designated as mandrel 41. Hollow cylinder 42 is slidably mounted on the exterior of mandrel 41. A plurality of collet fingers 43 are machined in the lower portion of cylinder 42 such that collet fingers 43 extend longitudinally therefrom. Each collet finger 43 has a collet head or lock member 44 formed near its extreme end as shown in FIG. 2C. Collet heads 44 project radially outward with respect to mandrel 41. Collet fingers 43 in cooperation with reduced outside diameter portion 41*a* of mandrel 41 allow collet heads 44 to flex radially inward when positioned adjacent thereto as shown in FIG. 2C. This flexibility is required to allow collet heads 44 to engage and disengage from recess 32. Cylinder 42, collet fingers 43, and collet heads 44 comprise a portion of the means for locking mandrel 41 within recess 32.

The exterior of mandrel 41 has a larger outside diameter portion 41*b* adjacent to reduced diameter portion 41*a*. Outside diameter portion 41*b* holds collet heads 44 from flexing radially inward when positioned adjacent thereto. Exterior portions 41*a* and 41*b* of mandrel 41 cooperate to provide backup means having a first position which allows flexing of collet heads 44 radially inward during engagement and disengagement with recess 32, and a second position which holds collet heads 44 against disengagement from recess 32. This second position is shown in FIG. 3B.

First frangible means or shear pins 45 hold the backup means in its first position. One or more shear pins 45 extend through hollow cylinder 42 and partially into mandrel 41. For ease of assembly, cylinder 42 has an internal, tapered shoulder 46 which contacts a matching external tapered shoulder 47 on mandrel 41. The longitudinal locations of tapered shoulders 46 and 47 are selected with reference to collet heads 44 and reduced diameter portion 41*a* to ensure that collet heads 44 can flex radially inward when shear pins 45 are installed. Shear pins 45 could be replaced by other well-known devices such as shear screws, a shear ring, or a detent. The preselected downhole location is partially defined by shoulder 33 formed by the lead-in of surface 26 into bore 27. With respect to latch 40, shoulder 33 functions as a no-go shoulder restricting the longitudinal movement of latch 40 into bore 27.

No-go shoulder 48 is machined on the exterior of cylinder 42 and is sized to contact matching no-go shoulder 33. The weight of upper portion 23*a* of production tubing string 23 provides means for applying force to mandrel 41 when no-go shoulders 33 and 48 are in contact with each other. This applied force acts upon shear pins 45 to release the backup means and to shift outside diameter portions 41*a* and 41*b* to their second position.

Second frangible means 50 including shear pins or shear screws 51 and sleeve 52 are provided to hold outside diameter portions 41*a* and 41*b* (the backup means) in their second position. Sleeve 52 is slidably disposed on the exterior of mandrel 41 and connected via shear screws 51 to cylinder 42. Snap ring 53 is slidably disposed on the exterior of mandrel 41 and abuts sleeve 52. Mandrel 41 has an annular groove 54 in its exterior near crossover 31. When the backup means is in its first position, snap ring 53 is spaced longitudinally from groove 54. Snap ring 53 is sized to be received within groove 54 when the backup means is in its second position as shown in FIG. 3A. Engagement of snap ring 53 and groove 54 cooperates to form stop shoulder 55 on the exterior of mandrel 41. The longitudinal spacing of groove 54 is selected relative to reduced diameter portion 41*a* so that stop shoulder 55 and sleeve 52 cooperate to trap the backup means in its second position.

Stop shoulder 55 could be provided by means other than snap ring 53 and groove 54. For example, snap ring 53 and groove 54 could be replaced by internal slips having teeth which bite into the exterior of mandrel 41 allowing movement of the slips in only one direction relative to mandrel 41. U.S. Pat. No. 3,167,127 shows internal slips satisfactory for this purpose.

The backup means remains trapped in its second position until after a predetermined amount of force has been applied to shear screws 51. Upward force generated by pulling on tubing string 23 is applied to mandrel 41 via crossover 31. This applied force acts upon shear screws 51 via stop shoulder 55 to release sleeve 52 from cylinder 42 and allow outside diameter portions 41*a* and 41*b* to return to their first position with reference to collet heads 44. Continued pulling on tubing string 23 results in collet fingers 43 flexing radially inward to release latch 40 from recess 32.

Seal means 57 are carried on the exterior of mandrel 41 to form a fluid barrier with bore 27 when latch 40 is secured therein. Seal means 57 maintain the fluid integrity of production tubing string 23.

Operating Sequence

FIGS. 2A, B and C show upper portion 23*a* of production tubing string 23 immediately after latch 40 has been inserted into bore 27. No-go shoulders 33 and 48 restrict the longitudinal movement of latch 40 into bore 27. Continued lowering of production tubing string 23 results in force being applied to shear pins 45. When this force exceeds a preselected value, pins 45 will be sheared into two portions 45*a* and 45*b* as shown in FIG. 3B. This same force will cause outside diameter portions 41*a* and 41*b* (the backup means) to shift to their second position which holds collet heads 44 against disengagement from recess 32. This movement activates the second frangible means by causing snap ring 52 to engage groove 54 which holds outside diameter portion 41*b* in its second position backing up collet heads 44. As best shown in FIG. 3B, latch 40 is anchored within bore 27 by outside diameter portion 41*b* holding collet heads 44 projected into locking recess 32.

Figure 4A:
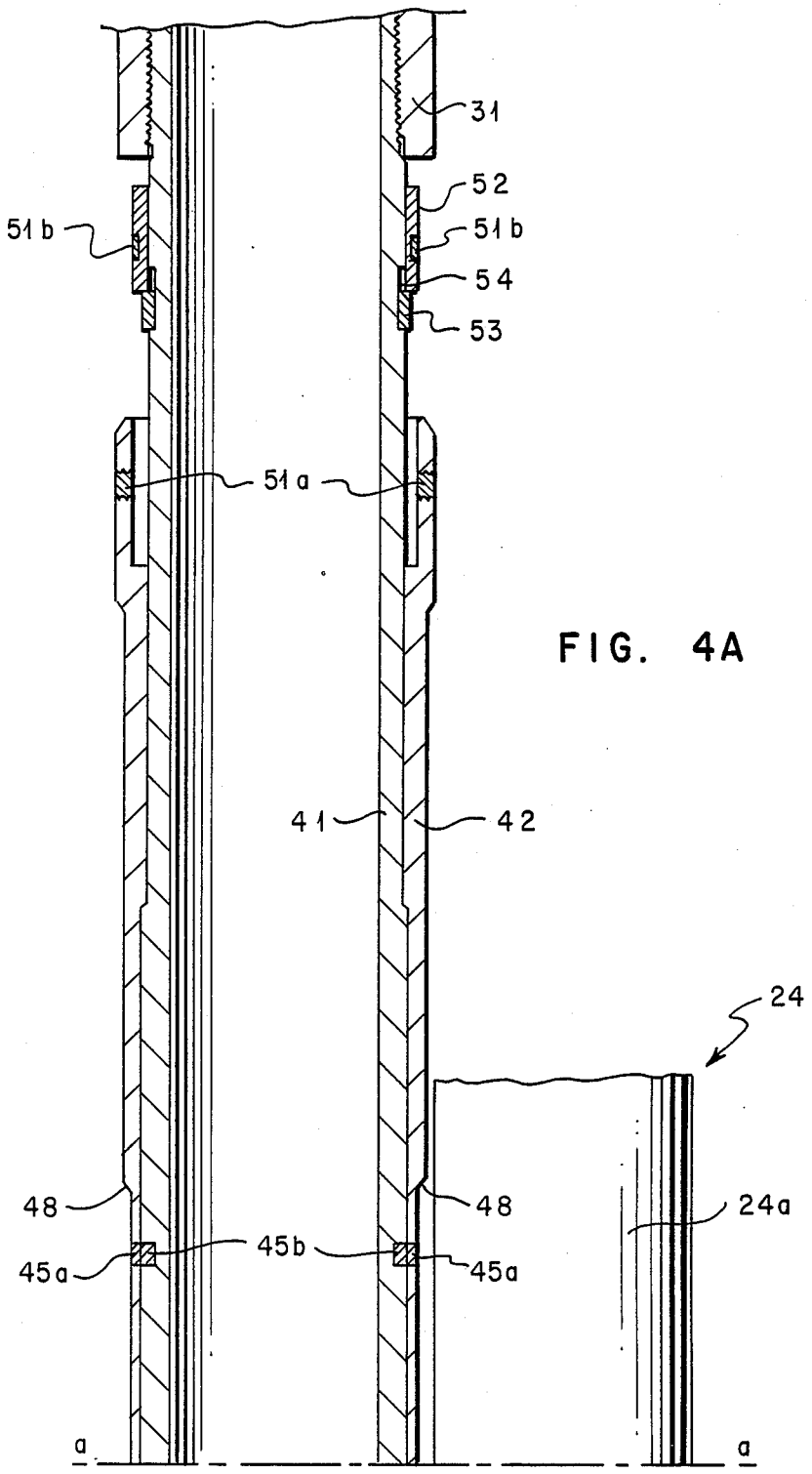
FIGS. 4A, B and C taken together constitute a longitudinal view in section and elevation with portions broken away showing the latch of FIGS. 2A, B and C after the production tubing string has been released from the packer guide head.
Figure 4B:
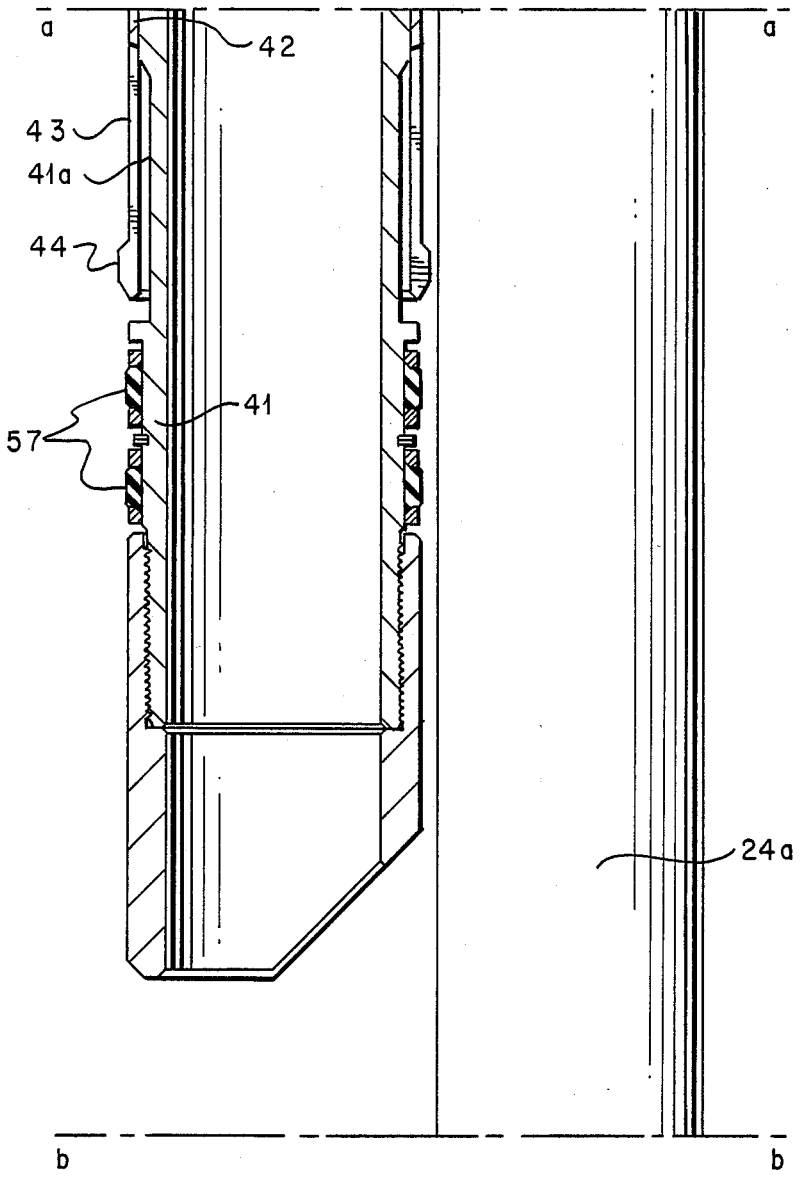
Figure 4C:
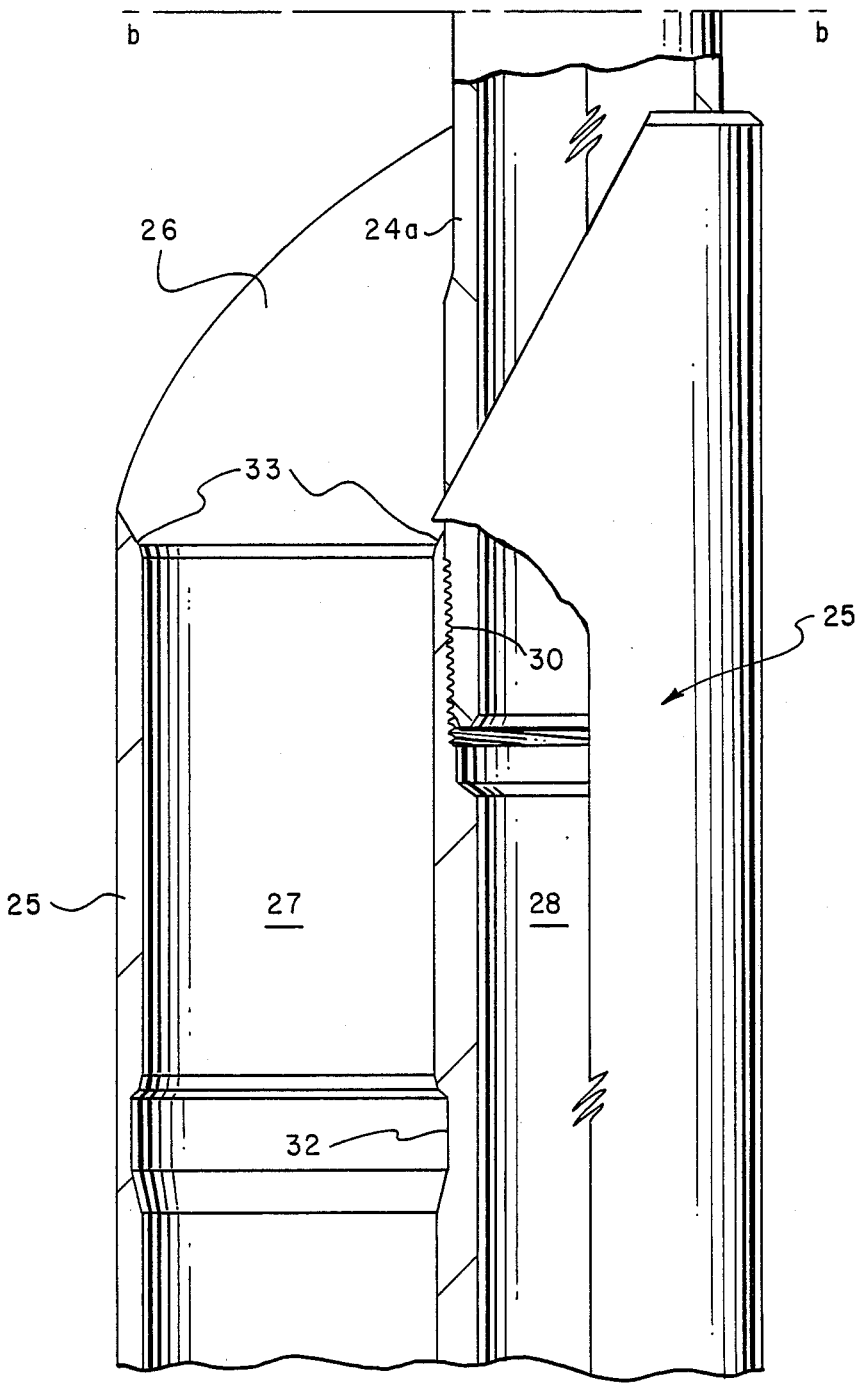

Latch 40 can be released from bore 27 by lifting production tubing string 23 which applies force to shear screws 51 via mandrel 41 and stop shoulder 55. When this force exceeds a preselected value, screws 51 will part allowing mandrel 41 to move longitudinally relative to cylinder 42. This movement returns the backup means to its first position. Continued lifting of tubing string 23 results in collet fingers 43 being flexed radially inward to release collet heads from recess 32. In FIGS. 4B and 4C, latch 40 is shown after release from bore 27. An important feature of this embodiment of the present invention is that a predetermined amount of force applied to mandrel 41 in one direction can anchor latch 40 within recess 32, and a predetermined amount of force in the opposite direction will release latch 40 from recess 32.

Alternative Embodiments

The present invention can be readily adapted to releasably anchor other well tools at a downhole location. For example, a locking device manufactured in accordance with the present invention could be used to anchor a production tubing within a liner hanger. Also, mandrel 41 could be modified by fishing necks for engagement with conventional wireline running and pulling tools rather than attachment to crossover 31. Such fishing necks would allow the present invention to be incorporated into downhole locking mandrels and landing nipples.

Collet heads 44 could be modified by adding a selective key profile to engage a matching profile in recess 32. The use of such selective key and recess profiles would eliminate the need for no-go shoulders 33 and 48 if desired. Also, second frangible means 50 can be modified to release the backup means by application of force in the same direction as required by first frangible means 45. Such modification can be accomplished by changing the disposition of snap ring 53 relative to sleeve 52.

Figure 7:
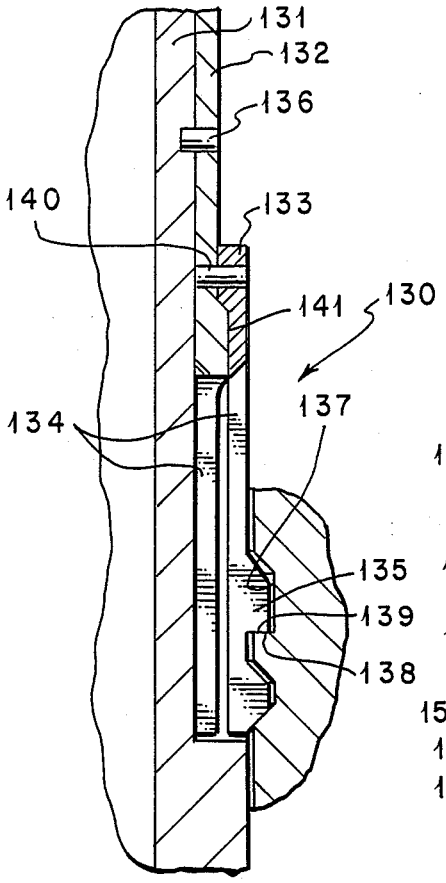
FIG. 7 is a fragmentary view in section showing an alternative embodiment of the present invention having a selective key profile which eliminates the need for stop shoulders.

Latch 130 as shown in FIG. 7 comprises mandrel 131, lockup cylinder 132 and collet ring 133 with collet fingers 134 extending longitudinally therefrom. Mandrel 131 is generally a hollow, elongated tubular member. Backup cylinder 132 is slidably disposed on the exterior of mandrel 131. A plurality of collet fingers 134 are machined in the lower portion of collet ring 133. Each collet finger 134 has a collet head or lock member 135 formed near its extreme end. Collet heads 135 project radially outward with respect to mandrel 131. Shear pin or first frangible means 136 holds backup cylinder 132 in its first position which allows collet fingers 134 to flex radially inward. This flexibility allows collet heads 135 to engage or disengage from recess 137.

Latch 130 can be used to releasably anchor well tools at a preselected downhole location defined in part by annular recess 137. Recess 137 and collet heads 135 are provided with matching profiles including square shoulders 138 and 139. The use of these shoulders 138 and 139 eliminates the need for no-go or stop shoulders 33 and 48 as described in the previous embodiment. Shear pin 140 prevents collet ring and attached collet fingers 134 from moving relative to backup cylinder 132 until after shoulders 138 and 139 have engaged each other. Application of a predetermined amount of force to backup cylinder 132, following such engagement, causes backup cylinder 132 to slide longitudinally relative to mandrel 131 and collet fingers 134. This longitudinal movement results in enlarged outside diameter portion 141 of backup cylinder 132 being positioned radially adjacent to collet heads 135. In this second position (not shown), backup cylinder 132 prevents the release of collet heads 135 from recess 137. Second frangible means similar to previously described shear screw 51, sleeve 52, snap ring 53 and annular groove 54 can be used to hold backup cylinder 132 in its second position.

Figure 8:
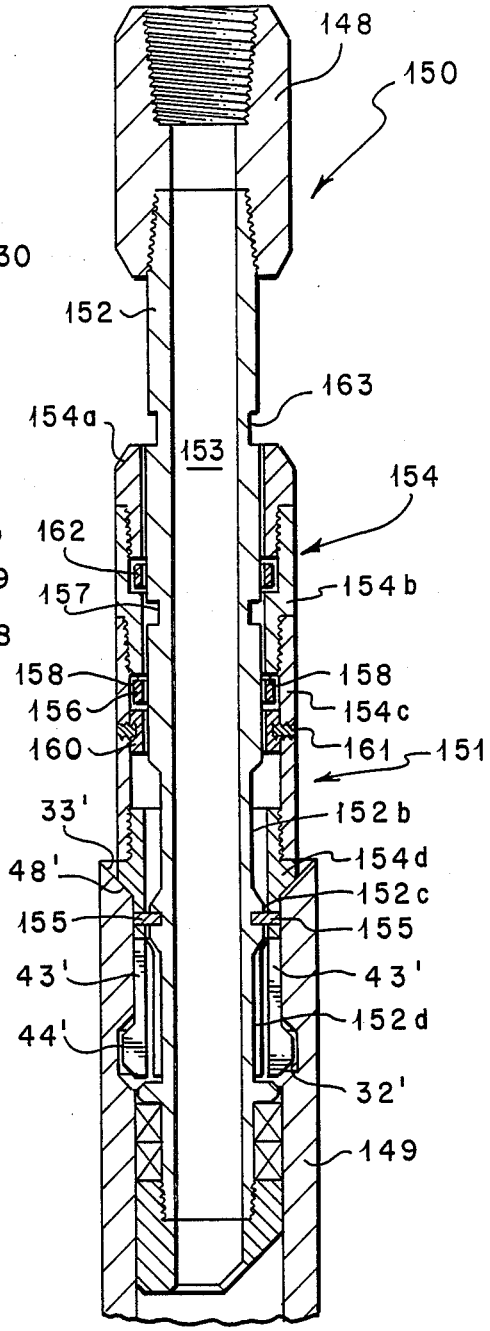
FIG. 8 is a schematic drawing in longitudinal section showing an alternative embodiment of the present invention used as a pulling tool.

Pulling tool 150 shown in FIG. 8 incorporates another alternative embodiment of the present invention designated as latch means 151. Pulling tool 150 includes mandrel means 152 which is a generally hollow, elongated tubular member with bore 153 extending longitudinally therethrough. The various components of latch means 151 are carried by and attached to mandrel means 152. Hollow cylinder 154 which has several subassemblies is slidably mounted on the exterior of mandrel means 152. A plurality of collet fingers 43 are machined in the lower portion of subassembly 154*d* such that collet fingers 43 extend longitudinally therefrom. Each collet finger 43 has a collet head or lock member 44 formed near its extreme end as shown in FIG. 8. Collet head 44 project radially outward with respect to mandrel means 152. Reduced outside diameter portion 152*d* of mandrel 152 cooperates with collet fingers 43 to allow collet heads 44 to flex radially inward when positioned adjacent thereto as shown in FIG. 8. This flexibility is required to allow collet heads 44 to engage recess 32 and defines the first position of latch means 151. First shear pins or frangible means 155 releasably hold cylinder 154 from sliding longitudinally relative to mandrel means 152 to further define the first position of latch means 151.

No-go shoulder 48' is provided on the exterior of cylinder 154 and is sized to contact matching no-go shoulder 33. Pulling tool 150 can be used to engage and pull any downhole tool (fish) 149 that has an appropriately sized no-go shoulder 33' and recess 32'.

Enlarged outside diameter portion **152*c* of mandrel means 152 holds collet heads 44' from flexing radially inward when positioned adjacent thereto. This relationship of enlarged portion 152*c* and collet heads 44' defines the second position (not shown) of latch means 151. First snap ring 156 is carried on the interior of cylinder 154 to engage first annular groove 157 when latch means 151 is in its second position Thus, upward pull on mandrel means 152 by tool joint (coupling) 148 will be transmitted through snap ring 156 to cylinder subassembly 154*b* via shoulder 158 to collet heads 44' and fish 149. Enlarged outside diameter portion 152*c* prevents collet heads 44' from releasing from recess 32' without regard to the amount of upward force applied to coupling 148**.

Pulling tool 150 is released from its second position by downward force on mandrel means 152 causing snap ring 156 to contact inner sleeve 160. When sufficient downward force is applied thereto, second frangible means or shear screws 161 will release inner sleeve 160 from the interior of cylinder 154. Mandrel means 152 can then travel downwardly relative to cylinder 154 until second snap ring 162 engages with second annular groove 163. Reduced diameter portion **152*b* is positioned adjacent to collet heads 44' by this same downward longitudinal movement. Thus, the third position (not shown) of pulling tool 150 is defined by second snap ring 162 engaged with second annular groove 163 to prevent any further longitudinal movement of cylinder 154 relative to mandrel means 152 and reduced diameter portion 152*b* cooperating with collet fingers 43' to allow collet heads 44' to flex inwardly to release pulling tool 150 from fish 149**.

Figure 9A:
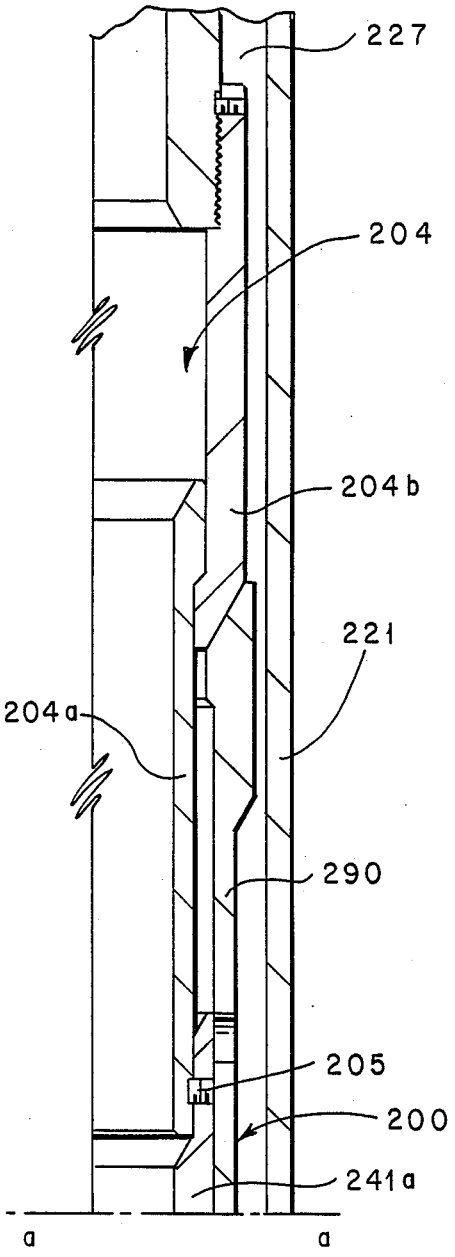
FIGS. 9A, B and C taken together constitute a longitudinal view, in half-section with portions broken away, of another embodiment of the present invention incorporated into a latch for downhole well tools.

Referring to FIGS. 9A, B and C, latch means 240 is provided to releasably anchor well tool 200 at a preselected location within well flow conductor 221. Downhole receptacle 222, attached by threads 223 to flow conductor 221 and forming a portion thereof, defines in part the preselected location. Bore 227 extends longitudinally through flow conductor 221 and receptacle 222. Flow conductor 221 could function as either casing 21 or production tubing string 24 of FIG. 1.

Well tool 200 is lowered through bore 227 and installed within receptacle 222 by running tool 204. Well tool 200 is removed from receptacle 222 by pulling tool 206 shown in FIG. **12*a*. Latching means 240 can be used to releasably anchor a wide variety of well tools within a well bore as long as a preselected downhole location is provided with an appropriate no-go shoulder and annular locking recess. Receptacle 222 provides such no-go shoulder 233 and locking recess 232**.

Figure 9C:
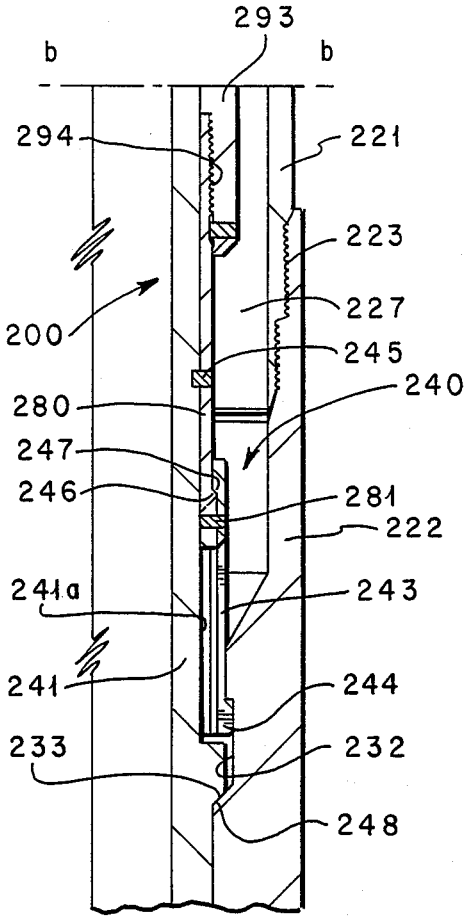
Figure 12A:
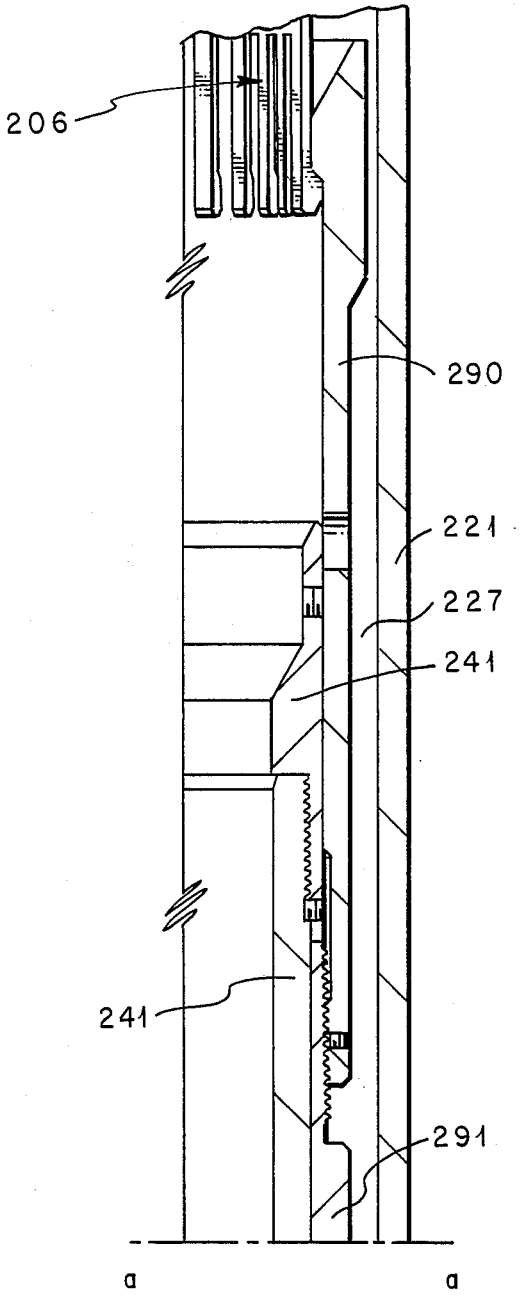
FIGS. 12A, B and C taken together constitute a longitudinal view, in half-section with portions broken away, showing the well tool of FIGS. 9A, B and C released from the downhole receptacle by a pulling tool.
Figure 11B:
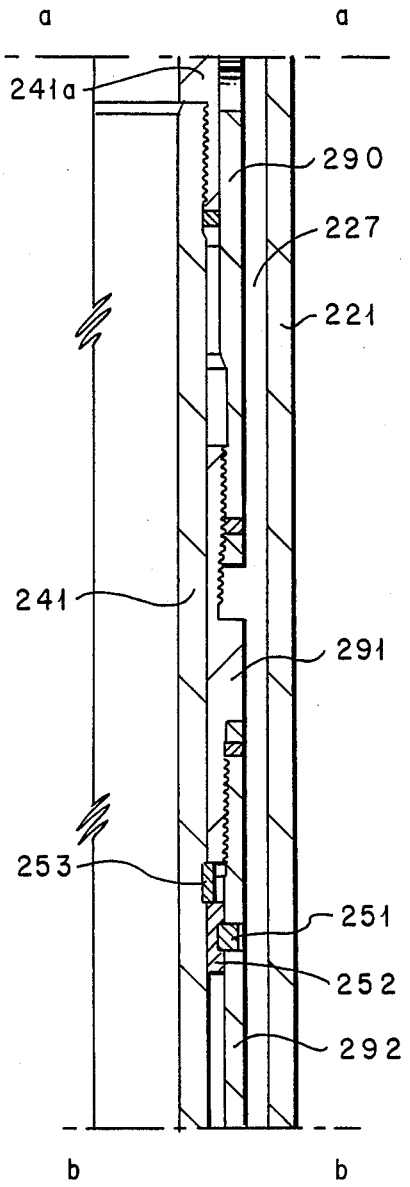
Figure 12B:
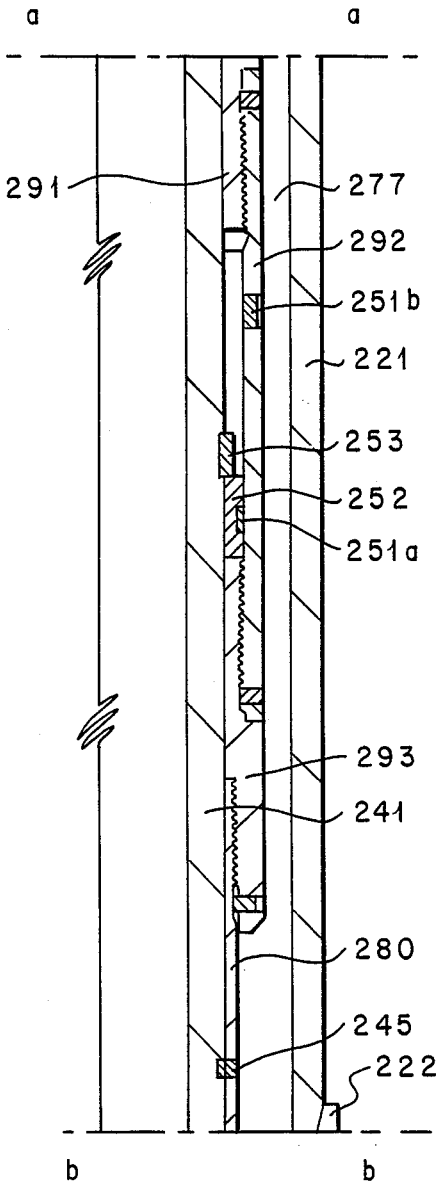
Figure 12C:
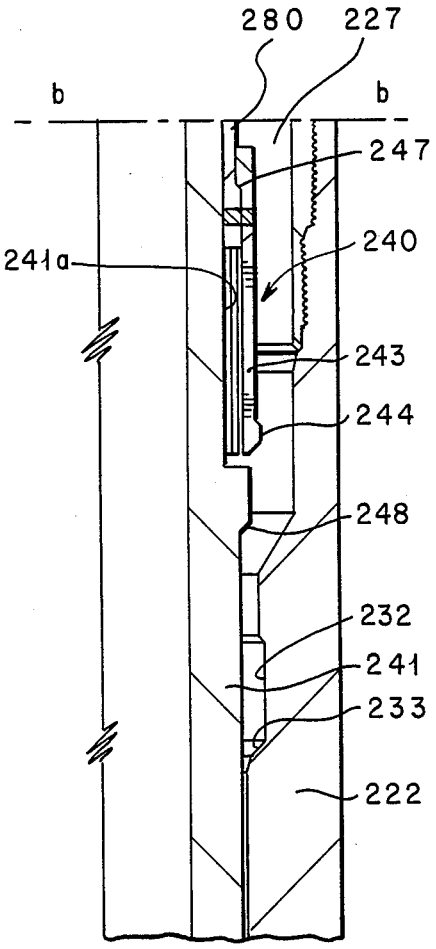

The various components of well tool 200 and latching means 240 are carried by and attached to a hollow, elongated tubular member designated as mandrel 241. A plurality of collet fingers 243, each having a collet head 244 formed near its extreme lower end, are carried on the exterior of mandrel 241. Collet heads 244 project radially outward with respect to mandrel 241. Collet finger 243 in cooperation with reduced outside diameter portion **241*a* of mandrel 241 allows collet heads 244 to flex radially inward. This flexing is required to allow collet heads 244 to engage recess 232 as shown in FIG. 9C or to disengage from recess 232 as shown in FIG. 12**C.

Figure 10A:
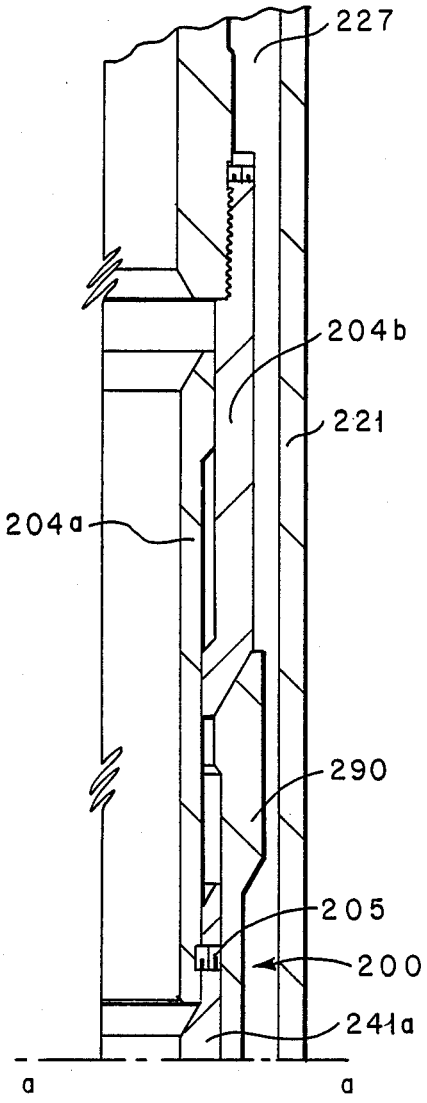
FIGS. 10A, B and C taken together constitute a longitudinal view, in half-section with portions broken away, showing the well tool and latch of FIGS. 9A, B and C releasably locked in a downhole receptacle.
Figure 9B:
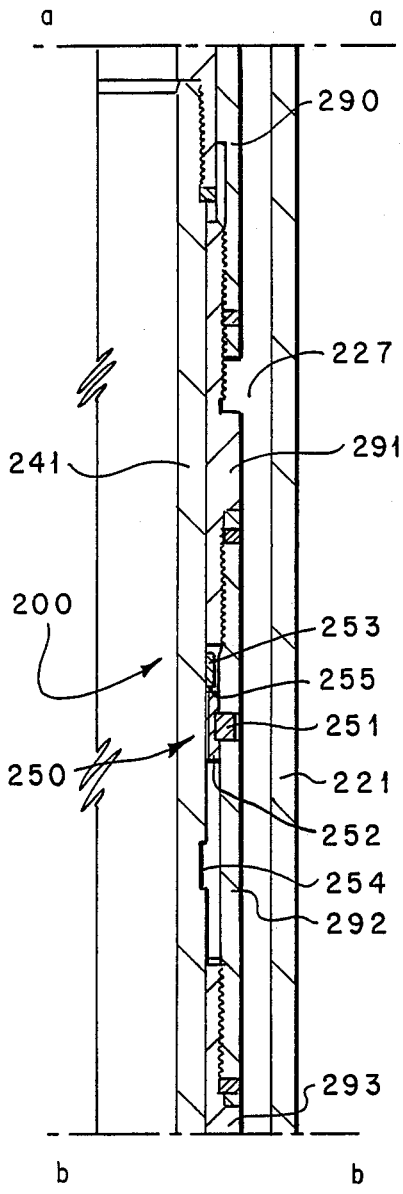
Figure 10B:
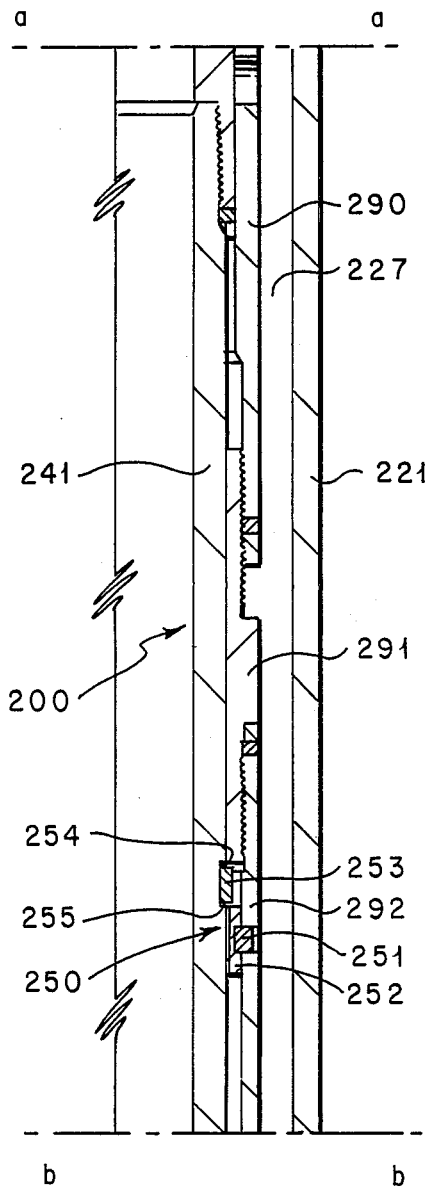
Figure 10C:
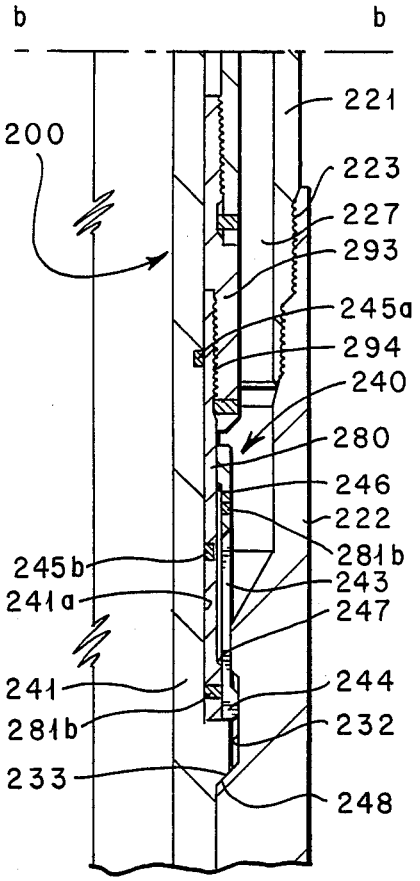

Backup cylinder 280 is slidably positioned on the exterior of mandrel 241 between collet fingers 243 and reduced outside diameter portion **241*a*. Backup cylinder 280 has a first position which allows collet heads 244 to flex radially inward and a second position as shown in FIG. 10C blocking collet heads 244 from flexing inward. First frangible means or shear pins 245 hold backup cylinder 280 in its first position. One or more shear pins 245 extend through backup cylinder 280 and partially into mandrel 241**.

Collet fingers 243 are machined in a cylinder which has an internal, tapered shoulder 246. For ease of manufacture and assembly, backup cylinder 280 has an external tapered shoulder 247 which contacts a matching internal, tapered shoulder 246. The longitudinal spacing of shear pin 245 and tapered shoulders 246 and 247 is selected with reference to collet heads 244 and reduced diameter portion **241*a* to ensure that collet heads 244 can flex radially inward when backup cylinder 280 is in its first position. An additional set of shear pins 281 is provided between backup cylinder 280 and collet fingers 243 to maintain this spacing of collet heads 244 when backup cylinder 280** is in its first position.

The preselected downhole location for releasably anchoring well tool 200 within well flow conductor or casing 221 is partially defined by shoulder 233 of receptacle 222. Shoulder 233 projects into bore 227 and forms a no-go restriction with respect to latch means 240. Mandrel 241 includes an enlarged outside diameter portion or no-go shoulder 248 which is sized to contact matching no-go shoulder 233. Running tool 204 comprises a portion of the means for applying force to first frangible means 245 when no-go shoulders 233 and 248 are in contact with each other. This force is applied to shear pin 245 by a series of hollow sleeves 290, 291, 292 and 293 threadedly engaged to each other and slidably carried on the exterior of mandrel 241. Running tool 204 abuts upper sleeve 290. Lower sleeve 293 is attached to backup cylinder 280 by threads 294. Thus, applying downward force to running tool 204 results in releasing backup cylinder 280 from its first position. This same force also acts on additional shear pins 281 to allow backup cylinder 280 to shift to its second position locking collet heads 244 into recess 232.

Second frangible means 250 including shear pins 251 and sleeve 252 are provided to hold backup cylinder 280 via sleeves 292 and 293 in its second position. Sleeve 252 is slidably disposed on the exterior of mandrel 241 and connected via shear screws 251 to sleeve 292. Snap ring 253 is slidably disposed on the exterior of mandrel 241 and abuts sleeve 252. Mandrel 241 has an annular groove 254 in its exterior. When the backup cylinder 280 is in its first position, snap ring 253 is spaced longitudinally from groove 254. Snap ring 253 is sized to be received within groove 254 when the backup cylinder 280 is in its second position as shown in FIG. 10B. Engagement of snap ring 253 and groove 254 cooperates to form stop shoulder 255 on the exterior of mandrel 241. The longitudinal spacing of groove 254 is selected relative to reduced diameter portion 241*a* so that stop shoulder 255 and sleeve 252 cooperate to trap the backup cylinder 280 in its second position.

Backup cylinder 280 remains trapped in its second position until after a predetermined amount of upward force is applied to shear pins 251. The upward force is generated by pulling tool 206 engaging cylinder 290 as shown in FIG. 12A and lifting cylinders 290, 291, 292 and 293. The force acts upon shear pins 251 via stop shoulder 255 to release cylinders 290, 291, 292 and 293 from mandrel 241 and to return backup cylinder 280 to its first position. Continued upward movement by pulling tool 206 results in collet fingers 243 flexing radially inward to release latch means 240 from recess 232.

If desired, various seal means or other well tools (not shown) could be attached to or carried by mandrel 241 below latch means 240. Well tool 200 with latch means 240 can be used as a retrievable bushing to centralize a drill string (not shown) within casing 221. Such bushings prevent rotation of the drill string from wearing the inner wall of casing 221. During acidizing, fracturing, or other high pressure servicing of the wellbore via a work string, seal means placed on mandrel 241 can reduce the piston effect of fluid pressure acting on the work string.

Operating Sequence for Well Tool 200

FIGS. 9A, B and C show well tool 200 immediately after latch means 240 has been inserted into receptacle 222 and collet heads 244 engaged with recess 232. No-go shoulders 233 and 248 restrict the longitudinal movement of well tool 200 through receptacle 222. Downward force is transmitted from running tool 204 to first frangible means 245 via cylinders 290, 291, 292, 293 and backup cylinder 280. Running tool 204 has two subsections 204*a* and 204*b* which can telescope relative to each other as shown in FIG. 10A. This telescoping movement allows running tool 204 to anchor latch means 241 within recess 232 as shown in FIG. 10C. Well tool 200 is now releasably engaged with receptacle 222 because snap ring 253 has been engaged in groove 254 and backup cylinder 280 has been shifted to its second position.

Figure 11A:
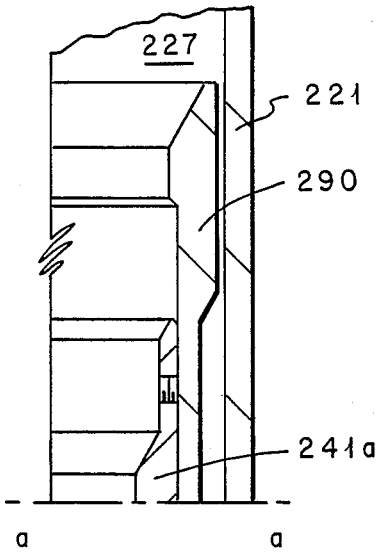
FIGS. 11A, B and C taken together constitute a longitudinal view, in half-section with portions broken away, showing the well tool of FIGS. 9A, B and C after the running tool has been removed therefrom.
Figure 11C:
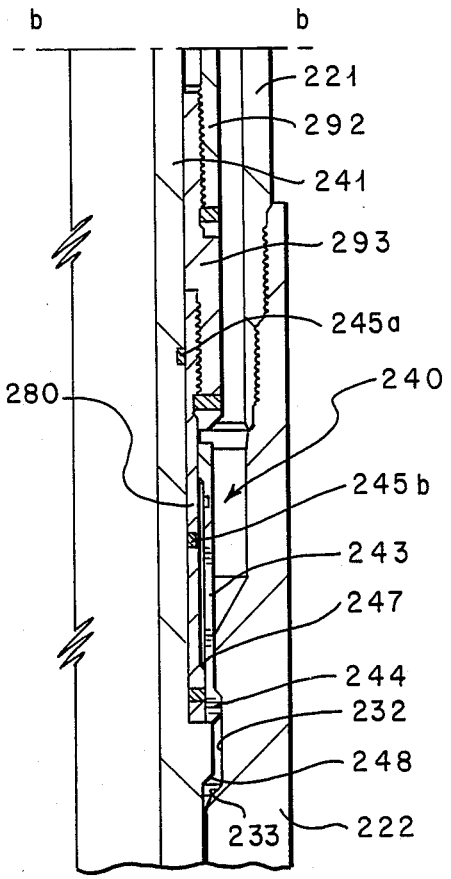

FIGS. 11A, B and C show that well tool 200 will remain secured within receptacle 222 even though fluid flow or fluid pressures might lift mandrel 241 to release the no-go contact between shoulders 233 and 248. See FIG. 11C. Collet heads 244 remain locked into recess 232 until backup cylinder 280 is returned to its first position. Second frangible means 250 prevents this movement until after pulling tool 206 or other suitable device can lift cylinders 290, 291, 292 and 293 relative to mandrel 241. FIGS. 12A, B and C show well tool 200 after it has been released from receptacle 222.

Those skilled in the art will readily see additional modifications and embodiments without departing from the scope of the invention as defined in the claims.

What is claimed is:

1. A latch for releasably anchoring well tools at a preselected downhole location defined in part by an annular recess comprising:

a. a mandrel;

b. means for locking the mandrel with the recess;

c. the locking means slidably mounted on the mandrel;

d. backup means having a first position which allows disengagement of the locking means from the recess and a second position which holds the locking means against disengagement from the recess;

e. first frangible means holding the backup means in its first position and releasing the backup means in response to application of a predetermined force tending to move the backup means to its second position; and f. second frangible means for holding the backup means in its second position.

2. A latch as defined in claim 1 wherein the mandrel comprises a hollow, elongated tubular member.

3. A latch as defined in claim 1 wherein the locking means further comprises:

a. a hollow cylinder slidably mounted on the exterior of the mandrel;

b. a plurality of collet fingers attached to and extending longitudinally from the cylinder; and c. each collet finger having a collet head near its extreme end sized to be received within the recess.

4. A latch as defined in claim 3 further comprising:

a. each collet finger and respective collet head spaced radially adjacent from the exterior of the mandrel when the backup means is in its first position whereby the collet fingers and collet heads may flex radially inward towards the mandrel; and b. the second position of the backup means being further defined as each collet head contacting the backup means whereby the collet heads are held against flexing radially inward.

5. A latch as defined in claim 3 wherein the first frangible means comprises a shear pin extending through the hollow cylinder and partially into the mandrel.

6. A latch as defined in claim 3 wherein the second frangible means comprises:

a. a sleeve slidably disposed on the exterior of the mandrel and connected via a plurality of shear pins to the locking means;

b. a stop shoulder on the mandrel; and c. the stop shoulder and sleeve cooperating to trap the backup means in its second position until after a predetermined amount of force has been applied to the shear pins.

7. The latch as defined in claim 6 wherein the backup means further comprises:

a. a reduced outside diameter portion of the mandrel allowing the collet heads to flex radially inward when positioned adjacent thereto; and b. a larger outside diameter portion of the mandrel holding the collet heads from flexing radially inward when positioned adjacent thereto.

8. A latch as defined in claim 7 further comprising:

a. a snap ring slidably disposed on the exterior of the mandrel and sized to be received within an annular groove therein;

b. the snap ring and groove spaced longitudinally from each other when the backup means is in its first position; and c. the stop shoulder formed by engagement of the snap ring with the annular groove.

9. The latch as defined in claim 3 further comprising:

a. a no-go shoulder on the exterior of the hollow cylinder sized to contact a matching no-go shoulder at the preselected downhole location;

b. means for applying force to the mandrel when the shoulders are in contact with each other; and c. the applied force acting on the first frangible means to allow shifting of the backup means to its second position.

10. The latch as defined in claim 9 further comprising:

a. means for connecting the mandrel to a production tubing string;

b. seal means carried on the exterior of the mandrel to form a fluid barrier at the preselected downhole location; and c. the tubing string transmitting force to act upon the first and second frangible means.

11. A locking device for releasably anchoring well tools in a downhole receptacle having an annular lock recess therein, comprising:

a. mandrel means;

b. lock means slidably mounted on the mandrel means and having lock members engageable in the lock recess;

c. backup means on the mandrel means movable to a position in which the lock members are held against disengagement from the lock recess;

d. first frangible means initially holding the backup means against movement to a position holding the lock members against disengagement from the lock recess and the first frangible means releasing the backup means in response to a predetermined force tending to move the backup means to its backup position; and e. second frangible means for holding the backup means in its backup position and being releasable upon application of a predetermined force tending to move the backup means out of its backup position.

12. A locking device as defined in claim 11 further comprising:

a. a no-go shoulder on the exterior of the locking device sized to contact a matching no-go shoulder on the interior of the receptacle;

b. contact between the no-go shoulders limiting the longitudinal movement of the locking device into the receptacle; and c. means for applying force to the mandrel after contact between the shoulders.

13. A locking device as defined in claim 12 further comprising:

a. means for attaching one end of the mandrel means to a well flow conduit; and b. seal means carried on the exterior of the mandrel means to form a fluid barrier with the adjacent interior of the receptacle.

14. A locking device as defined in claim 11 further comprising:

a. a hollow cylinder slidably mounted on the exterior of the mandrel means;

b. a plurality of collet fingers attached to and extending longitudinally from the cylinder;

c. each collet finger having a collet head on its extreme end sized to be received within the lock recess;

d. a reduced outside diameter portion of the mandrel allowing the collet heads to flex radially inward when positioned adjacent thereto; and e. a larger outside diameter portion of the mandrel backing up the collet heads and holding them from flexing radially inward when positioned adjacent thereto.

15. A locking device as defined in claim 14 wherein the first frangible means comprises a shear pin extending through the hollow cylinder and partially into the mandrel means.

16. A locking device as defined in claim 14 wherein the second frangible means comprises:

a. an annular groove in the exterior of the mandrel means;

b. a snap ring slidably disposed on the exterior of the mandrel means and spaced longitudinally from the groove while the first frangible means initially holds the backup means;

c. the snap ring sized to be received within the annular groove when the backup means is positioned adjacent to the collet heads;

d. a sleeve slidably disposed on the exterior of the mandrel means and connected via a plurality of shear pins to the locking means;

e. the snap ring and groove cooperating to form a stop shoulder when engaged with each other; and f. the stop shoulder and sleeve cooperating to trap the backup means adjacent to the collet heads until after a predetermined amount of force has been applied to the shear pins.

17. A locking device as defined in claim 11 wherein the predetermined forces to release the first frangible means and the second frangible means respectively is applied in the same direction by the mandrel means.

18. A locking device as defined in claim 11 wherein the lock members further comprise:

a. a hollow cylinder slidably mounted on the exterior of the mandrel means;

b. a plurality of collet fingers attached to and extending longitudinally from the cylinder;

c. each collet finger having a collet head on its extreme end sized to be received within the lock recess;

d. each collet head having a profile matching the profile of the lock recess; and e. the matching profiles providing no-go shoulders at the preselected downhole location.

19. A well tool having latch means for releasably anchoring the well tool in a downhole receptacle having an annular recess therein, comprising:

a. mandrel means;

b. lock means slidably mounted on the mandrel means and having lock members engageable in the lock recess;

c. backup means on the mandrel means movable to a position in which the lock members are held against disengagement from the lock recess;

d. first frangible means initially holding the backup means against movement to a position holding the lock members against disengagement from the lock recess and the first frangible means releasing the backup means in response to a predetermined force tending to move the backup means to its backup position;

e. second frangible means for holding the backup means in its backup position and being releasable upon application of a predetermined force tending to move the backup means out of its backup position;

f. a no-go shoulder on the exterior of the mandrel means sized to contact a matching no-go shoulder on the interior of the receptacle;

g. contact between the no-go shoulders limiting longitudinal movement of the mandrel means into the receptacle;

h. means for applying force to the mandrel means after contact between the shoulders; and i. seal means carried by the mandrel means to form a fluid barrier with the portion of the receptacle adjacent thereto.

20. A well tool as defined in claim 19 wherein the mandrel means has a longitudinal bore extending therethrough which allows the well tool to function as a retrievable bushing.

* * * * *